US006532595B1

(12) United States Patent
Holmes

(10) Patent No.: US 6,532,595 B1
(45) Date of Patent: Mar. 18, 2003

(54) COMBINATION CHILD'S APRON AND CHAIR SANITARY COVER

(76) Inventor: Monette Holmes, 149 Mill Cove La., Ponte Vedra Beach, FL (US) 32082

( * ) Notice: Subject to any disclaimer, the term of this patent is extended or adjusted under 35 U.S.C. 154(b) by 0 days.

(21) Appl. No.: 09/978,496

(22) Filed: Oct. 16, 2001

(51) Int. Cl.[7] ..... A41D 13/04; A41D 11/00

(52) U.S. Cl. ..... 2/48

(58) Field of Search ..... 2/46, 51, 47, 49.3, 2/50, 49.1, 49.2, 75, 69.5, 48, 52, 69, 111, 211, 214, 210; 297/465, 466, 467, 464, 219.12, 256.16, 219.1, 225, 228.11, 228.12, 229, 485; 128/846, 849, 853, 869, 872, 873; 5/494, 496, 482, 655

(56) References Cited

U.S. PATENT DOCUMENTS

| | | | | | |
|---|---|---|---|---|---|
| 346,006 | A | * | 7/1886 | Williamson | 2/214 |
| 616,026 | A | * | 12/1898 | Stein | 2/211 |
| 693,428 | A | * | 2/1902 | Ondrak | 2/214 |
| 751,452 | A | * | 2/1904 | Bird | 2/69.5 |
| 899,853 | A | * | 9/1908 | Willard | 2/50 |
| 1,205,384 | A | * | 11/1916 | Peck | 297/467 |
| 1,261,575 | A | * | 4/1918 | McLeod | 2/50 |
| 1,376,625 | A | * | 5/1921 | Johnston | 297/467 |
| 1,614,126 | A | * | 1/1927 | Hart | 2/48 |
| 1,802,540 | A | * | 4/1931 | Schmidt | 2/69.5 |
| 1,837,983 | A | * | 12/1931 | Moran | 2/49.4 |
| 2,005,294 | A | * | 6/1935 | Lazare | 2/48 |
| 2,325,097 | A | * | 7/1943 | Behringer | 128/873 |
| 2,362,465 | A | | 11/1944 | Carner | |
| 2,404,108 | A | * | 7/1946 | Stauffacher et al. | 297/467 |
| 2,420,916 | A | | 5/1947 | Sorge | |
| 2,449,741 | A | * | 9/1948 | Fitzpatrick | 2/48 |
| 2,457,725 | A | | 12/1948 | Rhowmine | |
| 2,532,932 | A | | 12/1950 | Neiswander | |
| 2,682,672 | A | * | 7/1954 | Moore | 128/872 |
| 2,738,511 | A | | 3/1956 | Brady | |
| 2,744,252 | A | * | 5/1956 | Cansler | 2/50 |
| 2,905,943 | A | | 9/1959 | Carlisle et al. | |
| 3,727,238 | A | | 4/1973 | Wolfson | |
| 4,235,474 | A | * | 11/1980 | Rosenberg | 297/465 |
| 5,437,061 | A | * | 8/1995 | Kenner | 2/69.5 |
| 5,897,164 | A | * | 4/1999 | Kagan et al. | 2/69 |
| 5,915,530 | A | | 6/1999 | Hager | |
| 5,956,766 | A | * | 9/1999 | Benway | 2/69.5 |
| 6,081,923 | A | | 7/2000 | Marks | |
| 6,128,781 | A | | 10/2000 | Spindler | |
| 6,237,998 | B1 | * | 5/2001 | Aprile | 297/219.12 |

* cited by examiner

*Primary Examiner*—Amy B. Vanatta
(74) *Attorney, Agent, or Firm*—Thomas C. Saitta

(57) ABSTRACT

A combination apron and chair cover for use with a high chair or toddler chair, where the apron and chair cover protects the child's clothing from spillage and prevents the child from contacting the upper surfaces of the chair with its hands or mouth, the cover having a torso opening which is cinched about the child's torso in a snug and secure manner and an outer perimeter of sufficient dimension to drape over the upper portion of the chair, including the chair back and tray if present. The outer perimeter is preferably secured to or between the chair legs or other chair structure by fastening elements.

22 Claims, 3 Drawing Sheets

COMBINATION CHILD'S APRON AND CHAIR SANITARY COVER

BACKGROUND OF THE INVENTION

This invention relates generally to the field of aprons or bibs used to protect clothing from being soiled or stained during eating or other activities, and especially to such aprons or bibs designed for infants or small children, and the invention simultaneously relates to the field of protective covers for chairs, high chairs and the like to protect the furniture from being soiled or stained and to prevent direct contact between the chair and the user. In terms of function, the invention is designed to prevent an infant or young child from being able to contact the chair itself with his or her hands or mouth while sitting in the chair.

It is common practice for restaurants to provide high chairs or toddler chairs to patrons bringing infants or small children in to dine. High chairs typically provide a tray mounted onto the chair, the chair having a vertical strap or bar disposed beneath the tray at the front of the seat to define a pair of leg-receiving holes to prevent the infant from sliding forward out of the chair. A toddler chair is typically a tray-less wooden structure having a flat seat, four vertical posts at each corner and four horizontal rails positioned atop the vertical posts to define a rectangular frame for restraint of the toddler, the front of the seat possibly having a vertical member to define the leg-receiving holes. Since these chairs are property of the restaurant, they are used successively by many different infants and children. Parents are typically conscientious in preventing soiling and staining of the infant's or child's clothing by utilizing a bib, but the chair itself is exposed during the eating process. Often the restaurant staff is lax in cleaning and sanitizing the chair in between uses, meaning that the infant or child is exposed to any unremoved food residue, saliva, vomit, urine, excrement, germs, viruses, etc., remaining on the chair after use by a previous occupant, either through touching the exposed chair surfaces with their hands or placing their mouths directly onto the chair. Typically, cleaning is attempted simply by wiping down the chair surfaces with a rag, a technique which is highly ineffective in removing germs. In addition to the prior user problem, it is common practice to invert a toddler chair so that an infant carrier can be placed between the leg rails, meaning that the horizontal rails forming the top of the toddler chair are placed directly on the floor. The restaurant staff will often simply invert the toddler chair back to its normal position after such use without cleaning the rails or seat area at all.

To address the sanitation problem, a parent bringing an infant or toddler to a restaurant must either bring in their own high chair or toddler chair, or attempt to sanitize the chair using cleaning material brought from home, both very inconvenient solutions. Thus, a conscientious parent using one of the restaurant chairs for the infant or toddler must constantly monitor the child to insure that the child is not touching or mouthing the possibly unsanitary portions of the chair.

A review of prior art does not reveal any devices designed to act in a manner which prevents the child from being able to touch or mouth the exposed portions of a high chair or toddler chair. The prior art falls into either the category of devices, such as aprons or bibs, used to prevent soiling or staining of the child's clothing, or cover devices used to cover the tray portion of the high chair, or combinations of the two. For example, U.S. Pat. No. 2,362,465 to Carner shows a vest-like bib having an attached forward pocket which is placed onto the tray. U.S. Pat. No. 2,457,725 to Rhowmine and U.S. Pat. No. 2,738,511 to Brady show similar devices with a standard bib, i.e., a chest covering member tied about the child's neck, connected to a tray covering pocket. U.S. Pat. No. 2,532,932 to Neiswander shows a combination tray cover and bib with sleeves. U.S. Pat. No. 5,915,530 to Hager shows a combination bib and tray cover which also acts as a disposable garbage bag. U.S. Pat. No. 6,128,781 to Spindler and U.S. Pat. No. 6,081,923 to Marks show bibs which attach to the rear of the tray. U.S. Pat. No. 3,727,238 to Wolfson is an example of a specialized apron which is attached about an invalid's waist. U.S. Pat. No. 2,420,916 to Sorge shows a protective shield which encircles the wearer's neck and can be used to cover the shoulders or to encase the head. Of course, it is well-known in the furniture art to provide fitted slip covers which completely encase a chair, sofa, table or the like, but these must be customized and form-fitted to a particular chair. Other than the full slip covers, none of the prior art devices act to prevent an infant or child from directly contacting the upper exposed parts of the high chair or toddler chair with the hands or mouth. Bibs and aprons do not provide a sanitary barrier between the child and the chair. Tray covers do not cover the seat, arms, back and other exposed surfaces of the chair. The use of full slip covers for this purpose is both an impractical solution, in that chair sizes and designs may vary and provision must be made for properly locating the leg-receiving holes on different chairs, and a non-optimal solution, since a slip cover structure creates a pocket or receptacle area in the seat which would entrap all spilled material, causing the child's clothing to be even more likely to be soiled or stained.

It is an object of this invention therefore, to provide a combination apron and chair cover device for a high chair or toddler chair, where the device acts as a barrier preventing direct contact between the child's hands and mouth and the chair, so that the child cannot come into contact with germs, food residues, etc., which may be present on the chair. It is an object to provide such a device which covers the tray, arms, seat back and all other surfaces within reach of the child. It is a object to provide such a device which also acts as an apron to prevent dropped or spilled food or liquids from soiling or staining the child's clothes. It is an object to provide such a device which is convenient and simple in application and use, which is disposable or readily cleanable, and which is usable with any high chair or toddler chair. It is an object to provide such a device which is securable about the torso of the child between the waist and armpits of the child, and which preferably has means to secure the device to or about the chair such that the child cannot remove the cover from portions of the chair. These objects expressly set forth, as well as other objects which will become apparent after review of the full disclosure, are supported by the following disclosure.

SUMMARY OF THE INVENTION

The invention comprises in general a sanitary or protective cover for a high chair or toddler chair, the purpose of the device being to cover the exposed portions of the chair to prevent the child occupying the chair from being able to touch or contact the chair surfaces with the hands or mouth. Furthermore, the invention is a combination apron, cape or bib-like device which simultaneously protects the child's clothing from food or liquid spills, where the device encircles the child's torso between the waist and armpits in a relatively snug manner.

The invention comprises a main body formed as an expanse of cloth, plastic or similar material dimensioned such that the outer perimeter edge or edges will drape over the sides of the chair, and over the tray as well if one is attached to the chair, such that the outer edge or edges extend well below the upper surfaces of the chair. The outer edge or edges may define a circular, oval, polygonal, cross-like or other configuration. A generally centralized torso opening defined by an interior edge of preferably circular shape is provided of sufficient size to allow the device to encircle a child's torso. Cinching means, such as for example drawstrings, elastic members, hook and loop fasteners, etc., are provided such that the torso opening can be drawn tight about the child's body.

Preferably, securing means are provided to temporarily attach the outer edge or edges of the main body to each other or to the lower portions of the chair, and may comprise straps, mechanical fasteners, hook and loop fasteners, drawstrings, elastic members, etc., such that the child cannot pull up the outer edge or edges to expose the upper portions of the chair.

In an alternative embodiment, a seat member is provided in the device to cover the seat of the chair, the seat member being connected to and depending from the torso opening and having one or two openings to receive the legs of the child therethrough.

DETAILED DESCRIPTION OF THE INVENTION

With reference to the drawings, the invention will now be described in detail with regard for the best mode and the preferred embodiment. In a most general sense, the invention is a combination apron and chair cover, where the term apron is taken herein to refer to an expanse of flexible sheet, web, cloth or cloth-like material adapted to be secured to and cover a portion of a child's body and clothing, and in particular to cover the body and clothing below a point on its torso situated between the armpits and waist, where the material functions in the manner of an apron, bib, smock or cape to prevent soiling of clothing from spilled food or liquid, and further where the expanse of material covers the upper portions of a chair, and in particular a high chair or toddler chair of common style, in a manner which creates a barrier to prevent the child using the chair from directly contacting the seat or upper portion of the chair with its hands or mouth. The invention may be composed of any suitable sheet material, such as cloth fabric, stretchable cloth-like material, plastic, paper or the like, in natural or processed form, such as backed, treated with liquid repellent or stain repellent, or provided with a liquid impermeable cover layer. The sheet-like material is most preferably either washable or disposable. The sheet-like material may have decorative printing or ornamentation, and may be provided with additional functional elements such as pockets or the like.

Figure 1:
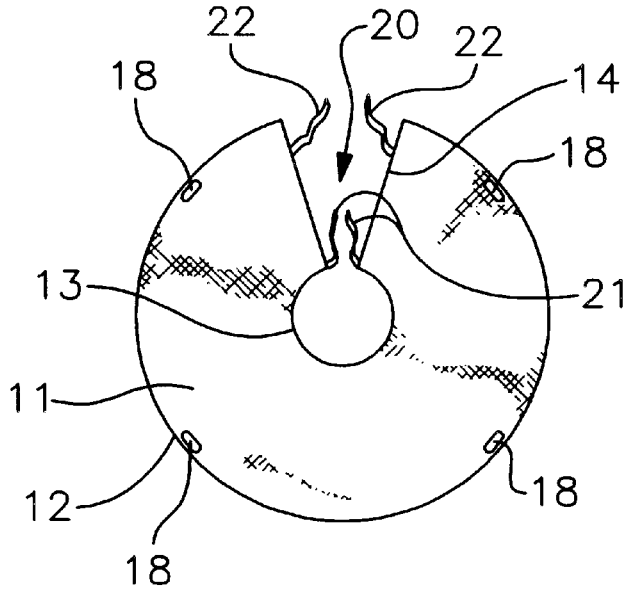
FIG. 1 is a view of an embodiment of the invention having a circular outer perimeter and a slit extending between the outer perimeter and the torso opening.
Figure 3:
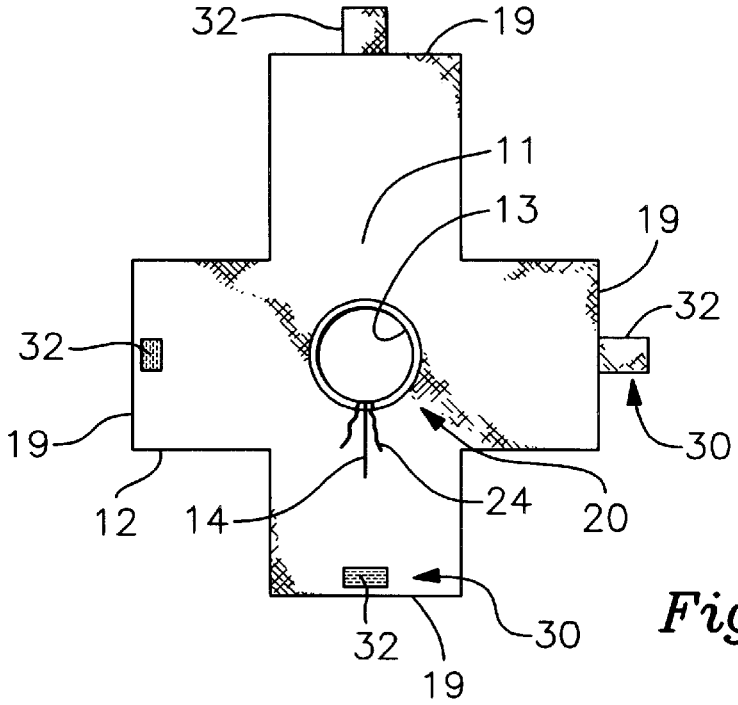
FIG. 3 is a view of an embodiment of the invention having a cross-shaped outer perimeter, a drawstring cinching means for the torso opening and hook and loop fasteners for securing means.
Figure 6:
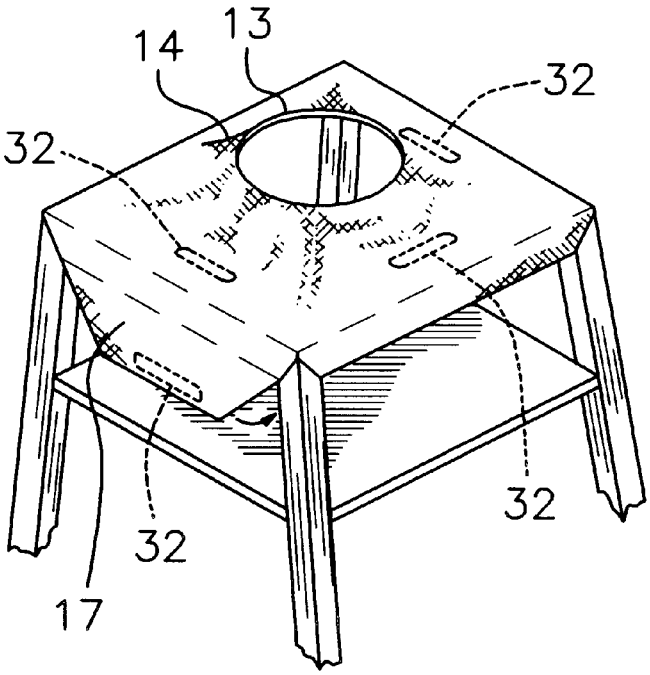
FIG. 6 is a perspective view of an alternative embodiment for the invention structured to be secured to the horizontal rails of a toddler chair.

A basic embodiment of the invention is shown in FIG. 1, which illustrates a main body 11 in sheet form having a circular outer perimeter 12 and a generally centralized torso opening 13. A slit member 14 extends from the outer perimeter 12 to the torso opening 13, such that the main body 11 can be easily positioned about the torso of a child by wrapping the main body 11 and securing the slit member 14. Alternatively, the slit member 14 may extend from the torso opening 13 only partially through the main body 11, not reaching the outer perimeter 12, as seen in FIGS. 3 and 6. The outer perimeter 12 may be hemmed or unhemmed, and may be provided with attached weight members 18, such as relatively heavy metal or plastic objects, to maintain the outer perimeter 12 in the draped position when in use. The torso opening 13 is preferably circular as shown, but may also be elliptical, rectilinear, etc. The torso opening 13 is provided with cinching means 20 for tightening the torso opening 13 about the torso of a child between its waist and armpits, which in this figure is shown to comprise tie or strap members 21, but equivalent means such as mechanical fasteners, snaps, hooks, buttons, zippers, hook and loop fasteners, drawstrings, elastic members, etc. may also be utilized. Additional slit closure members 22, such as ties, straps, mechanical fasteners, buttons, zippers, hook and loop fasteners, elastic members or the like may be provided to insure that the main body 11 covers the chair over the full circumference with no gaps. While dimensions may vary, it has been found that a minimum diameter of about 48 inches for a circular outer perimeter 12 provides satisfactory results in practice where the device is to be draped over the chair 99.

Figure 2:
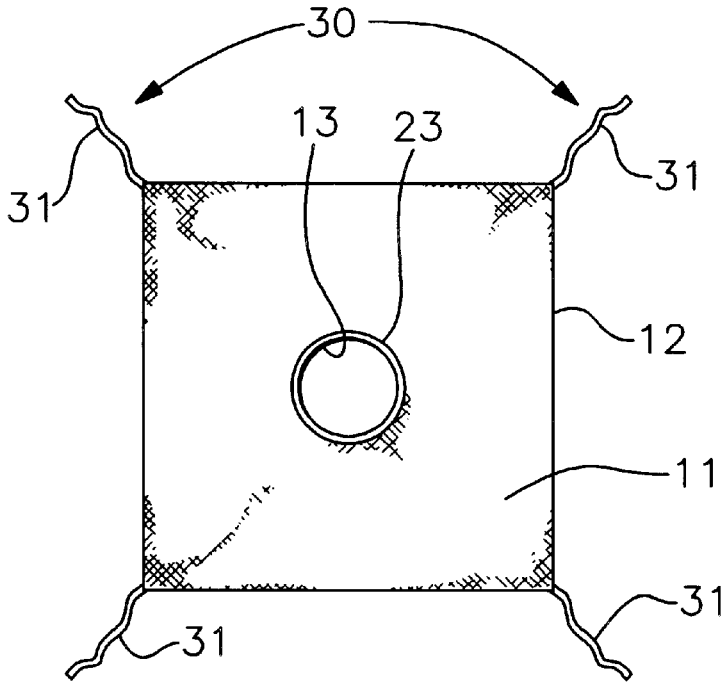
FIG. 2 is a view of an embodiment of the invention having a square outer perimeter, elastic cinching means for the torso opening and external tie straps for securing means.

FIG. 2 illustrates an alternative embodiment where the main body 11 is composed of an elastic material and the cinching means 20 for tightening the torso opening 13 about the child's torso comprises an elastic member or stitching 23, such that the main body 11 is placed onto the child by expanding the torso opening 13 to bring it down over the child's body. The elastic member 23 then contracts to secure the main body 11 about the child. As shown in this figure, the outer perimeter 12 of the main body 11 is generally rectilinear, and chair securing means 30 in the form of tie straps 31 are provided such that the main body 11 can be fastened to the legs of the chair 99 itself, or alternatively the corners of the main body 11 can be pulled between the chair legs and tied to each other. The chair securing means 30, by temporarily affixing the outer perimeter 12 to the arms, seat or legs of the chair 99, or by temporarily joining the outer perimeter 12 through the chair legs and to itself, insures that the child cannot pull up the outer perimeter 12 to expose a portion of the chair 99. Alternative structures or elements for the chair securing means 30 may include elastic members, mechanical fasteners, hooks, hook and loop fasteners or other equivalent members.

FIG. 3 illustrates another embodiment for the invention, in which the main body 11 has a cross-shaped outer perimeter 12 and where the cinching means 20 for the torso opening 13 comprises a drawstring member 24 used in combination with a slit member 14. Chair securing means 30 in this figure comprise mating hook and loop fasteners 32 positioned on the arms 19 of the cross-shaped main body 11, with the arms 19 being of sufficient length to allow them to connect under the seat and between the legs of a chair 99 for temporary joining. Preferably as shown, one arm 19 of the main body 11 is longer than the other arms 19. This added length accounts for the situation where the invention is used with a backed high chair 99 or a chair 99 with a tray, the added length allowing the front and back arms 19 to be joined by chair securing means 30 beneath the chair seat.

Figure 4:
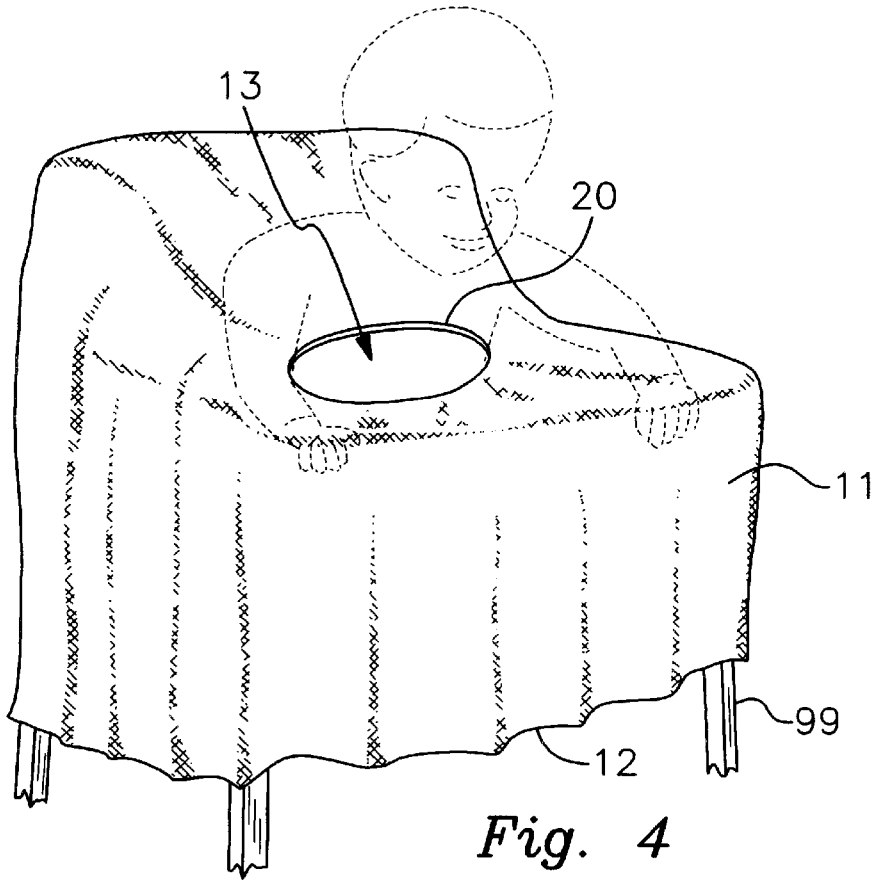
FIG. 4 is an illustration showing the invention as positioned on a high chair.

Use of the invention is shown in FIG. 4, where it is seen that the main body 11 drapes over the chair 99 in all directions, completely covering the back, arms, seat, tray and the upper portions of the legs, so that no chair structure is exposed within reach of the child, thereby insuring that the child cannot touch or place its mouth onto the chair 99. The outer perimeter 12 hangs down a sufficient distance to prevent the child from being able to pull it up to expose portions of the chair 99, or preferably chair securing means 30 are provided and utilized as described above to temporarily affix the device to the chair 99. The cinching means 20 insures that the torso opening 13 is drawn tightly about the child's torso at a point between its waist and armpits, thus insuring that the child cannot push its hands and arms through the torso opening 13, and further acts to prevent food and liquid from soiling the child's clothing.

Figure 5:
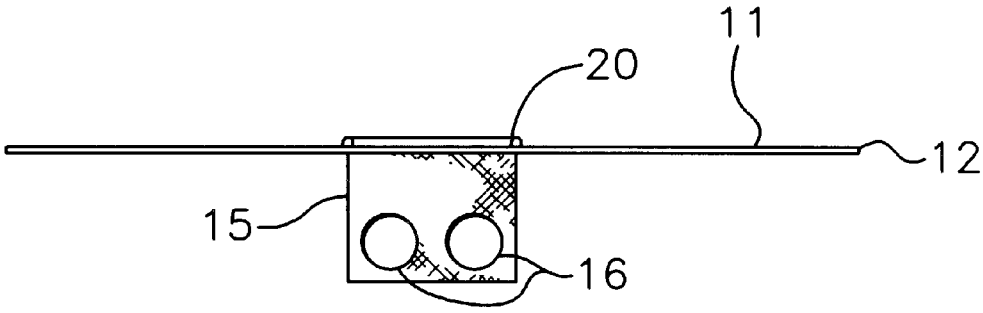
FIG. 5 is an edge view of an embodiment of the invention having a seat member and leg apertures.

FIG. 5 illustrates still another alternative embodiment for the invention, where the main body 11 is provided with an attached or integrated seat member 15 depending from the main body 11 about said torso opening 13, the seat member being provided with at least one and preferably a pair of leg apertures 16. In this embodiment, the child's legs and clothing are protected from contacting the chair seat itself, insuring that its clothing remains clean of any residue or food spills which may remain on the seat. As before, cinching means 20 in the form of a drawstring or the like is provided to tighten the main body 11 about the child's torso so that no food or liquid will be spilled into the interior of the seat member 15.

FIG. 6 illustrates an embodiment of the invention structured specifically for use on a toddler chair 99 having horizontal rail members on vertical post members defining a raised rectangular frame to retain the toddler. The main body 11 containing the torso opening 13 is provided with four flap members 17, the flap members 17 being adapted to be wrapped under and around the horizontal rail members of the chair 99 and fastened to the underside of the main body 11 using chair securing means 30, such as with hook and loop fasteners 32 as shown, to secure the device in place during use.

It is understood that equivalents and substitutions for certain elements or structure as set forth above may be obvious to those skilled in the art, and thus the true scope and definition of the invention is to be as set forth in the following claims.

I claim:

1. A combination apron and chair cover device in combination with a chair, said chair having an upper structure adapted to receive a seated child, said combination apron and chair cover device comprising a main body composed of a flexible sheet material having a torso opening adapted to encircle a child's torso, cinching means to tighten said torso opening about such child's torso, and an outer perimeter adapted to drape over said upper structure of said chair, whereby said main body prevents spillage onto such child and prevents such child from contacting said upper structure of said chair.

2. The device of claim 1, wherein said cinching means are chosen from the group of cinching means consisting of ties, straps, mechanical fasteners, snaps, hooks, buttons, zippers, hook and loop fasteners, drawstrings, and elastic members.

3. The device of claim 1, further comprising a slit member extending from said torso opening.

4. The device of claim 3, further comprising slit closure members to close said slit member.

5. The device of claim 4, wherein said slit closure members are chosen from the group of slit closure members consisting of ties, straps, mechanical fasteners, buttons, zippers, elastic members, and hook and loop fasteners.

6. The device of claim 1, further comprising chair securing means for temporarily securing said main body to such chair's upper structure.

7. The device of claim 6, wherein said chair securing means are chosen from the group of chair securing means consisting of ties, straps, elastic members, mechanical fasteners, hooks, and hook and loop fasteners.

8. The device of claim 1, further comprising a seat member depending from said main body about said torso opening, said seat member having at least one leg aperture.

9. A combination child's torso apron and chair cover device in combination with a chair, said combination apron and chair cover device comprising a main body composed of a flexible sheet material, a torso opening disposed in said main body, cinching means to tighten said torso opening, an outer perimeter, and chair securing means affixed to said main body, whereby said combination apron and chair cover device is temporarily secured to said chair.

10. The device of claim 9, wherein said cinching means are chosen from the group of cinching means consisting of ties, straps, mechanical fasteners, snaps, hooks, buttons, zippers, hook and loop fasteners, drawstrings, and elastic members.

11. The device of claim 9, further comprising a slit member extending from said torso opening.

12. The device of claim 11, further comprising slit closure members to close said slit member.

13. The device of claim 12, wherein said slit closure members are chosen from the group of slit closure members consisting of ties, straps, mechanical fasteners, buttons, zippers, elastic members, and hook and loop fasteners.

14. The device of claim 9, wherein said chair securing means are chosen from the group of chair securing means consisting of ties, straps, elastic members, mechanical fasteners, hooks, hook and loop fasteners.

15. The device of claim 9, further comprising a seat member depending from said main body about said torso opening, said seat member having at least one leg aperture.

16. A combination child's apron and chair cover device in combination with a chair for encircling the torso of a child to protect the child from spilling food onto its clothing while simultaneously covering said chair to preclude the child from touching or mouthing the upper portions of the chair, said device comprising a main body composed of a flexible sheet material, a torso opening disposed in said main body, cinching means to tighten said torso opening, an outer perimeter, and chair securing means affixed to said main body, whereby said combination apron and chair cover device is temporarily secured to said chair.

17. The device of claim 16, wherein said cinching means are chosen from the group of cinching means consisting of ties, straps, mechanical fasteners, snaps, hooks, buttons, zippers, hook and loop fasteners, drawstrings, and elastic members.

18. The device of claim 16, wherein said chair securing means are chosen from the group of chair securing means consisting of ties, straps, elastic members, mechanical fasteners, hooks, hook and loop fasteners.

19. The device of claim 16, further comprising a slit member extending from said torso opening.

20. The device of claim 19, further comprising slit closure members to close said slit member.

21. The device of claim 20, wherein said slit closure members are chosen from the group of slit closure members consisting of ties, straps, mechanical fasteners, buttons, zippers, elastic members, and hook and loop fasteners.

22. The device of claim 16, further comprising a seat member depending from said main body about said torso opening, said seat member having at least one leg aperture.

* * * * *